US006083048A

United States Patent [19]

Yamaguchi

[11] Patent Number: 6,083,048

[45] Date of Patent: Jul. 4, 2000

[54] SHIELDING CONNECTOR

[75] Inventor: Noboru Yamaguchi, Shizuoka, Japan

[73] Assignee: Yazaki Corporation, Tokyo, Japan

[21] Appl. No.: 09/129,362

[22] Filed: Aug. 5, 1998

[30] Foreign Application Priority Data

Aug. 7, 1997 [JP] Japan ..... 9-213510

[51] Int. Cl.[7] ..... H01R 13/648

[52] U.S. Cl. ..... 439/608; 439/701; 439/610

[58] Field of Search ..... 439/607–610, 439/79, 701

[56] References Cited

U.S. PATENT DOCUMENTS

Re. 36,065 1/1999 Andrews et al. ..... 439/608

5,851,121 12/1998 Thenaisie et al. ..... 439/63

FOREIGN PATENT DOCUMENTS 4-87185 7/1992 Japan .

*Primary Examiner*—Khiem Nguyen

*Attorney, Agent, or Firm*—Armstrong, Westerman, Hattori, McLeland & Naughton

[57] ABSTRACT

A shielding connector comprises a connector housing being divided in two parts by an inner housing and an outer housing, the connector housing including an inside terminal for electrically connecting a terminal which is inserted within an opponent connector, a terminal chamber for accommodating the inside terminal, and a shielding case surrounding the inside terminal the inner housing being integrally formed with the terminal chamber on an inner surface of a bottom wall of the connector housing and being coupled with an outer surface of the shielding case, and the outer housing having an inserting hole being formed at a wall of the connector housing so that the inner housing can fully close an opening of the inserting hole.

10 Claims, 11 Drawing Sheets

SHIELDING CONNECTOR

BACKGROUND OF THE INVENTION

1. Field of the Invention

The present invention relates to a shielding connector which is used in an electronic control appliance.

2. Description of the Prior Art

A shielding connector connecting a shielding wire is described, for example, at Japanese Utility Patent Application Laid-open No. 4-87185.

As shown in FIG. 11A, the shielding connector comprises a connector housing 1 and an assembling part 2 attached inside the connector housing 1.

The connector housing 1 is made of an electrical insulator and comprises an outer wall 3 and a cylinder 4 formed integrally with the outer wall 3. An opponent connector C is inserted into a concave portion 5 between the outer wall 3 and the cylinder 4.

As shown in FIG. 11B, the assembling part 2 comprises a terminal chamber 6 made of an electrical insulator, an inside terminal 7, a medium portion of which the terminal chamber 6 accommodates, and a metal shielding case 8 fitting an outer surface of the terminal chamber 6. The assembling part 2 is inserted in the cylinder 4.

As shown in FIG. 12, an opponent terminal 9 which is accommodated within a connector housing of the opponent connector C comprises an inner terminal 10 connecting a core of a shielding wire W and an external terminal 11 connecting a braided wire of the shielding wire W.

When the opponent connector C accommodating the opponent terminal 9 in the connector housing 1 is inserted in the concave portion 5, the inner terminal 10 is electrically connected to the inside terminal 7 and the external terminal 11 is mechanically connected to the shielding case 8.

There is a drawback that this connector housing 1 becomes complicated because of being integrally formed with the outer wall 3 and the cylinder 4. There is a drawback that an assembling operation becomes complicated because the assembling part 2 needs many parts.

An operation for attaching the assembling part 2 to the connector housing 1 is performed by inserting the shielding case 8 into the cylinder 4 after putting within the shielding case 8 the inside terminal 7 which is accommodated in the terminal chamber 6. So, there is a drawback that a position error of the inside terminal 7 arranged in the connector housing 1 is worse for corresponding to total position errors of all parts.

SUMMARY OF THE INVENTION

An object of the present invention is to provide a shielding connector which has as few components as possible, and is assembled by performing easier operations, and then has a highly position accuracy of the inside terminal.

According to the present invention, the effect of this invention will be described below.

(1) The shielding connector is two divided type of a connector, comprising the outer case and inner case without regard to a substrate attaching type or a terminal inserting type of a connector. So, the shielding connector has simpler inner structures than those of a conventionally used shielding connector and take two advantages that the material cost of the connector housing is reduced and an operation of attaching the shielding case is performed more easily.

(2) By one touch performance of inserting the inner housing into the outer housing, the outer housing positions the inner housing and is fixed to the inner housing without being detached to each other, and then an opening of an inserting hole for inserted in the inner housing is fully closed by the inner housing. So, an assembling operation of the present invention becomes easier than that of a conventionally used shielding connector.

(3) The inner housing is positioned directly by the inserting hole of the outer housing. The inside terminal has more highly position accuracy.

BRIEF DESCRIPTION OF THE DRAWING

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention

DESCRIBING OF THE PREFERRED EMBODIMENT

As referring to figures, a shielding connector of a first embodiment of the present invention will be described below.

Figure 5A:
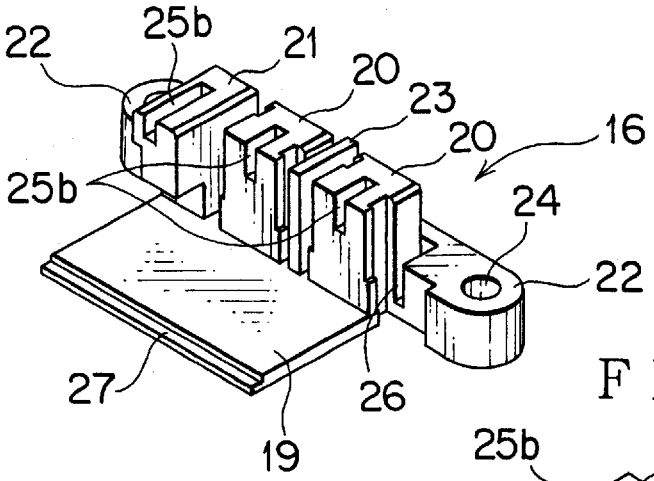
FIG. 5A is a perspective view showing the inner housing without the inside terminals.
Figure 5B:
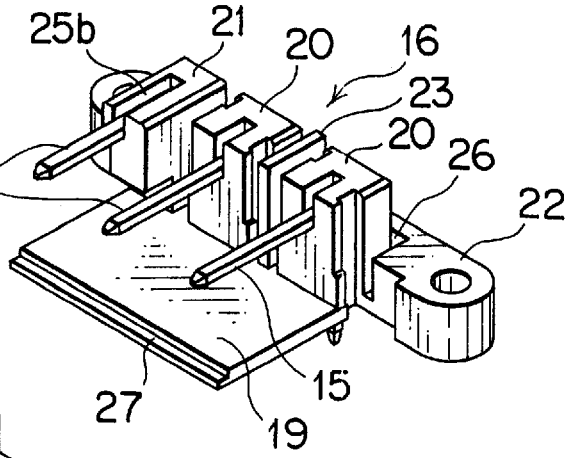
FIG. 5B is a perspective view showing the inner housing with the inside terminals.
Figure 5C:
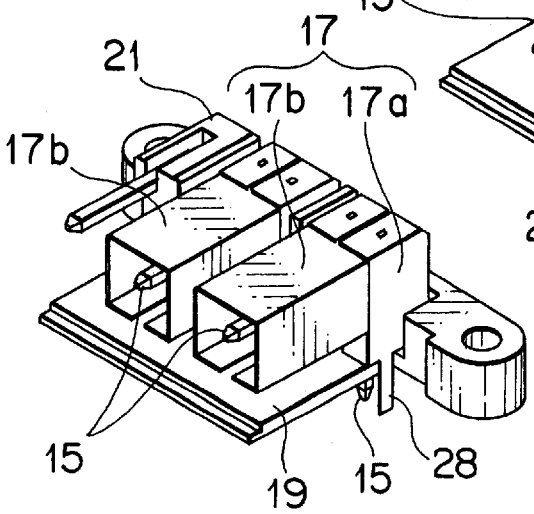
FIG. 5C is a perspective view showing the inner housing with the shielding case.
Figure 5D:
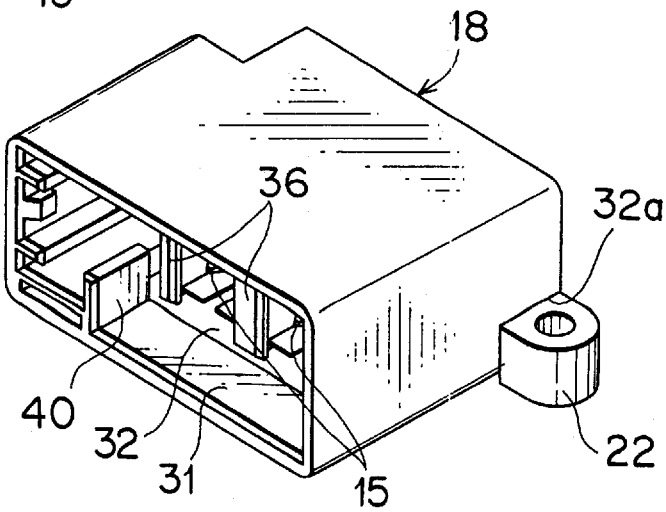
FIG. 5D is a perspective view showing the outer housing of the shielding connector.

A shielding connector A1 attached to a board attached A1 comprises four parts, that is, inside terminals 15, an inner housing 16 (in FIG. 5B), a metal shielding case 17 (in FIG. 5C), and an outer housing 18 (in FIG. 5D).

The inner housing 16 comprises a bottom wall 19 corresponding to a partially outer wall of a conventionally used connector housing, terminal chambers 20, 21 arranged on an upper surface (in FIG. 5A) of the bottom wall 19, arms 22 projected from both side walls of the terminal chambers 20, 21, and a guide wall 23 arranged between two terminal chambers 20. A hole 24 (in FIG. 5A) is formed on each upper surface of the arms 22.

There are terminal accommodating holes 25 in the terminal chambers 20, 21. As shown in FIG. 6B, each of terminal accommodating holes 25 composes a through hole 25*a* in an up-and-down direction and a groove 25*b* extending in left direction from a medium portion of the through hole 25*a*. A groove 26 is formed on a border between the terminal chambers 20, 21 and the arms 22. A bottom of the groove 26 is in the same surface as the upper surface of the bottom wall 19. A first step 27 is formed at an opponent end surface of the bottom wall 19 against the arms 22.

A lower surface of the bottom wall 19 (as shown in FIG. 6B) abuts on a print board P. The inside terminals 15 inserted into the terminal accommodating hole 25 are formed like L. Each lower end of the inside terminals 15 is connected to the print board P.

Figure 1:
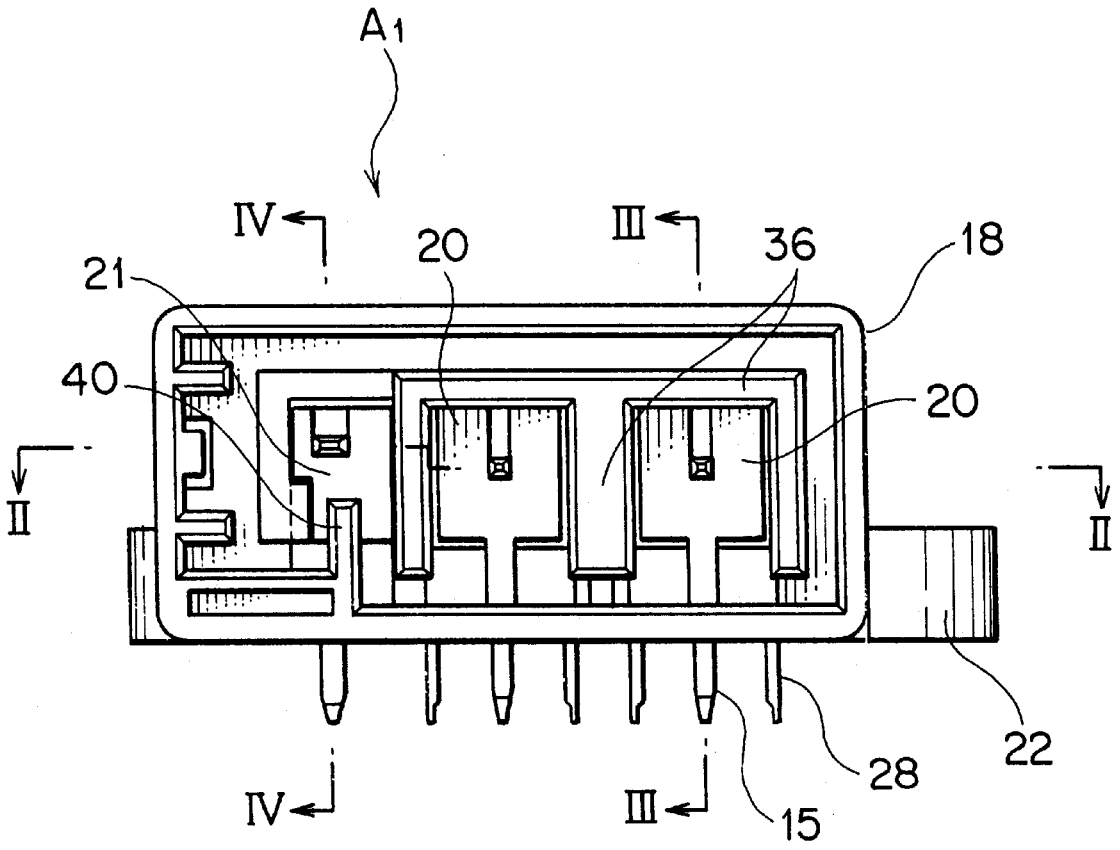
FIG. 1 is an elevational view of a shielding connector attached to a board which shows the first embodiment of a present invention.
Figure 2:
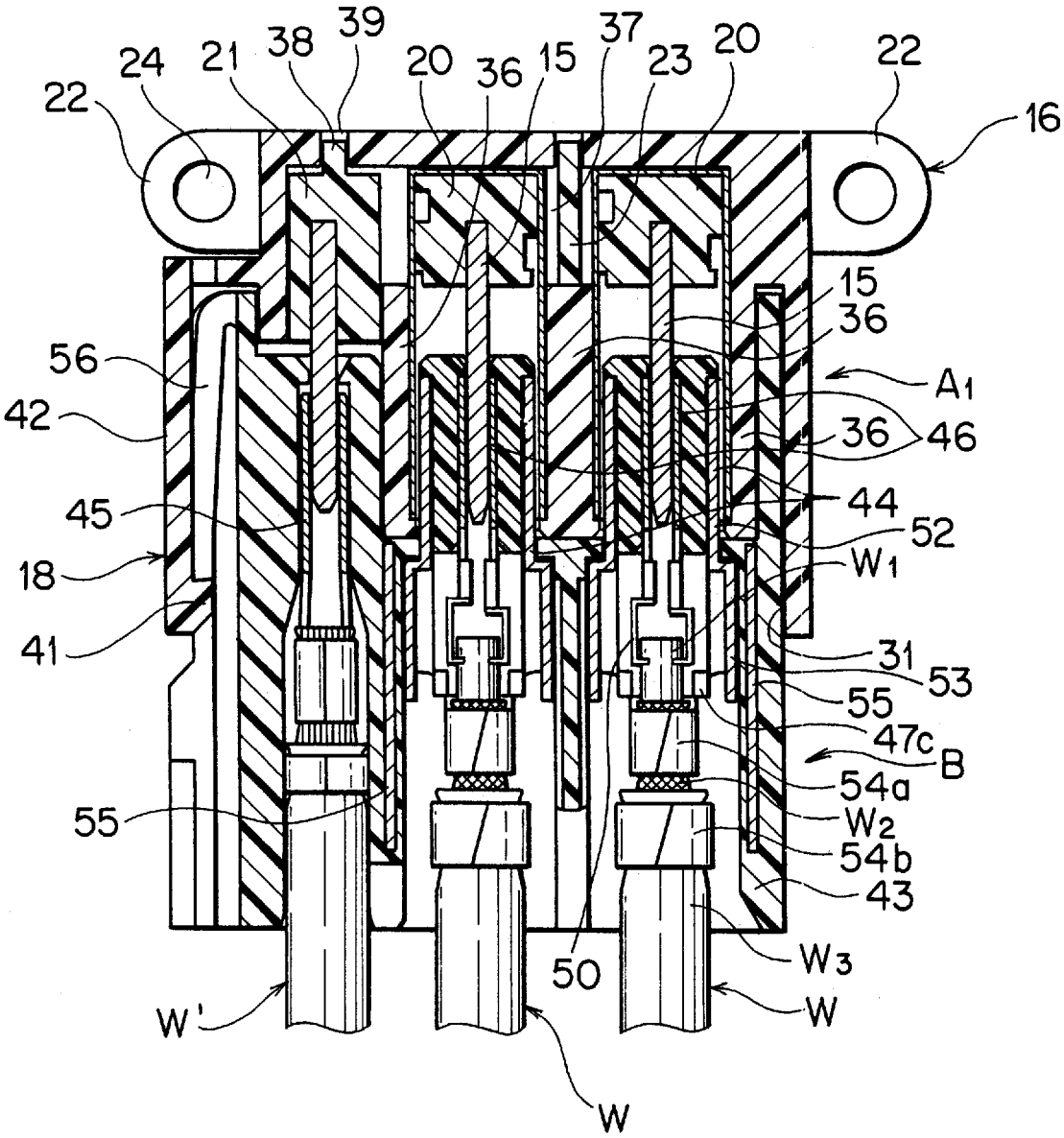
FIG. 2 is a section view taken on line 2—2 in FIG. 1.
Figure 3:
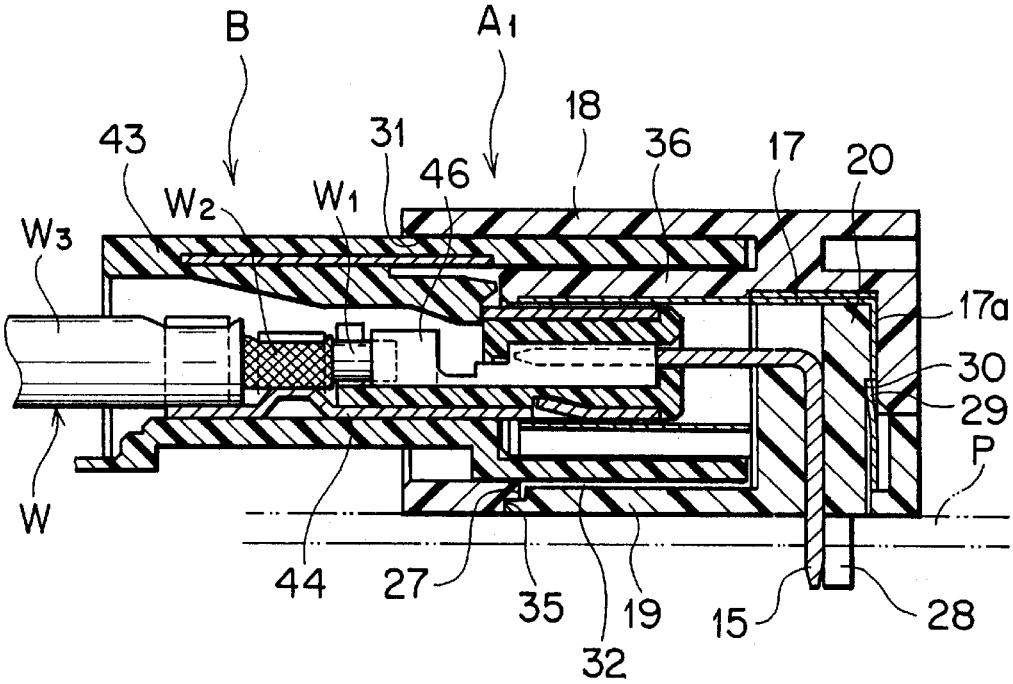
FIG. 3 is a section view taken on line 3—3 in FIG. 1.

As shown in FIGS. 2 and 3, each of the inside terminals 15, accommodated in the terminal chamber 20, is connected to an inner female-type terminal 46 of a shielding wire W. An shielding case 17 being coupled on each outer surface of the terminal chambers 20 incorporates the inside terminals 15.

The inside terminal 15 being accommodated in the terminal chamber 21 is one for a covered wire W'. So, the shielding case 17 is not attached to an outer surface of the terminal chamber 21.

As shown in FIG. 5C, the shielding case 17 comprises horizontal tubes 17*a* fitted in the terminal chamber 20 and vertical tubes 17*b* extending from an upper portion of the horizontal tubes 17*a*. Shielding terminals 28 project from each lower end of the horizontal tubes 17*a*.

As shown in FIG. 3, a finger 29 is mounted inside from each outer surface of the horizontal tubes 17*a*, while a groove 30 is formed on each outer surface of the terminal chambers 20.

And, when a lower end of the shielding case 17 accommodates the terminal chambers 20 and abuts on the bottom wall 19, the fingers 28 are engaged with the groove 30. So, the inner housing 16 and the shielding case 17 are fixed without being detached each other.

Thus, each lower end of the shielding terminals 28 is through the bottom wall 19.

Figure 4:
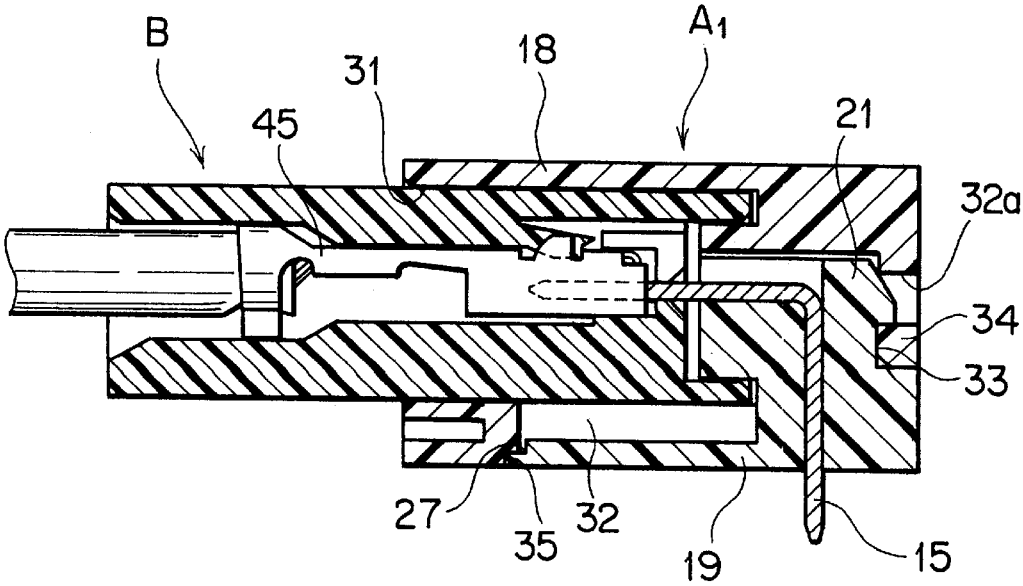
FIG. 4 is a section view taken on line 4—4 in FIG. 1.
Figure 11A:
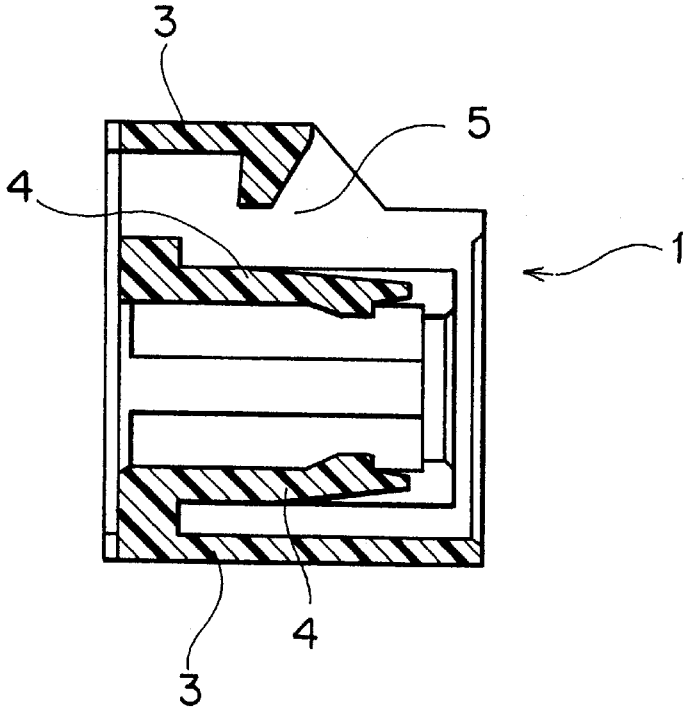
FIG. 11A PRIOR ART
FIG. 11A is a sectional view of a connector housing of an conventionally used shielding connector.
Figure 11B:
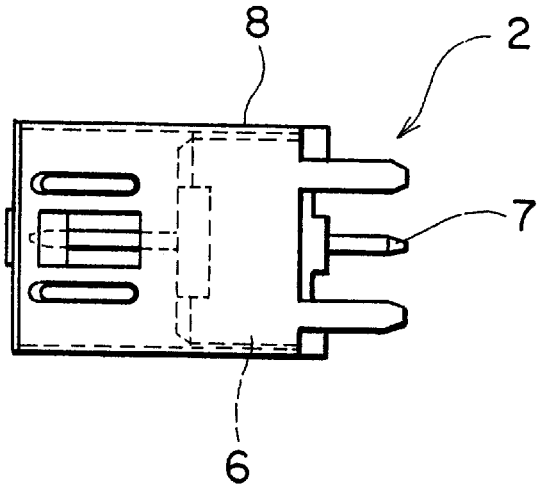
FIG. 11B PRIOR ART
FIG. 11B is an elevational view of an assembling part inserted into the connector housing.
Figure 12:
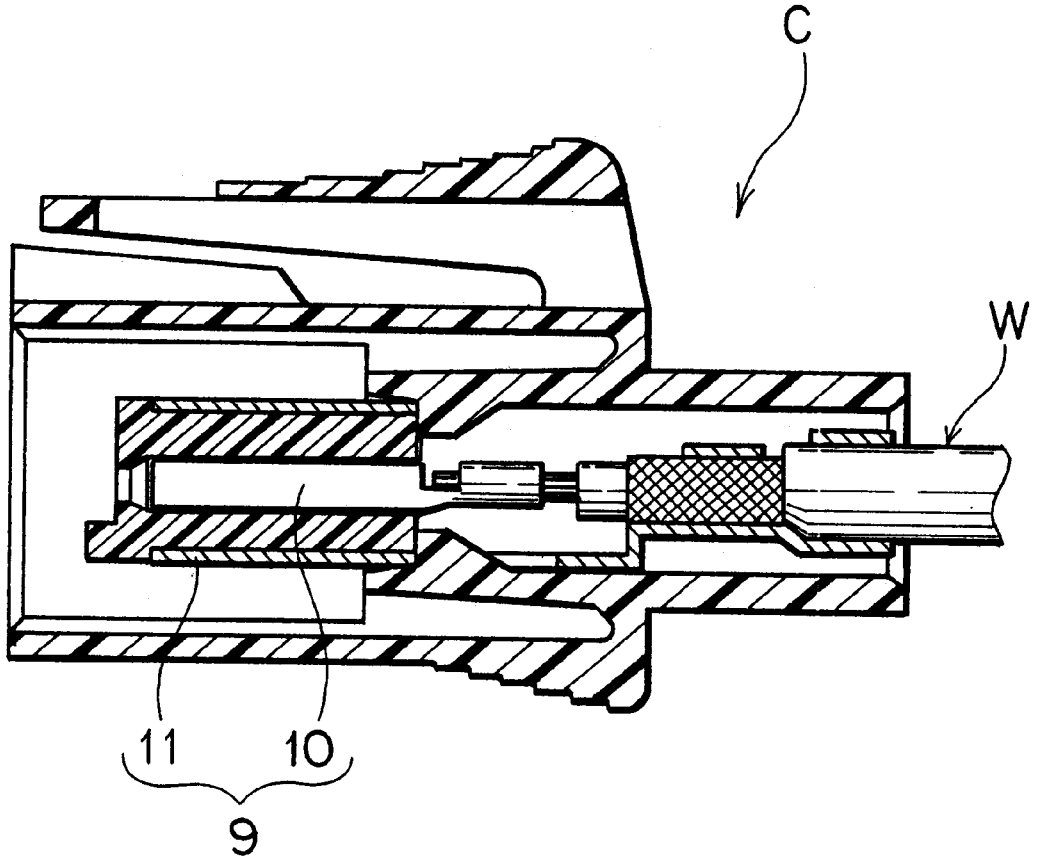
FIG. 12 PRIOR ART
FIG. 12 is a sectional view of an opponent connector coupled in the shielding connector.

As shown in FIG. 4, the outer housing 18 corresponds to the outer wall 3 of the conventionally used connector housing 1 (in FIG. 11), and has a hole 31 in a front surface thereof for coupled with an opponent connector B and an inserting hole 32 in a lower surface of the connector housing 18 for receiving the inner housing 16.

As shown in FIG. 5D, the outer housing 18 has recesses 32*a* at both sides thereof for receiving the arms 22, and, as shown in FIG. 4, an second portion 34 being arranged in an inner surface of the outer housing 18 in order to be secured with a first portion 33, and then a second step 35 being located so as to correspond to the first step 27. The first portion 33 is formed on an outer surface of the terminal chamber 21.

The terminal chambers 20 are inserted between partitions 36 being arranged on an inner surface of the outer housing 18.

As shown in FIG. 2, the outer housing 18 has a hole 37 for inserting the guide wall 23 of the inner housing 16 and a hole 39 for a projection 38, which is formed on outer surface of the terminal chamber 21.

As shown in FIG. 5D, in an outer surface of the outer housing 18, a rib 40 is formed so that a front surface of the rib 40 is the same surface as that of an opening of the hole 31 and that both side surfaces of the rib 40 are parallel with an inserting direction of the opponent connector B.

Figure 10:
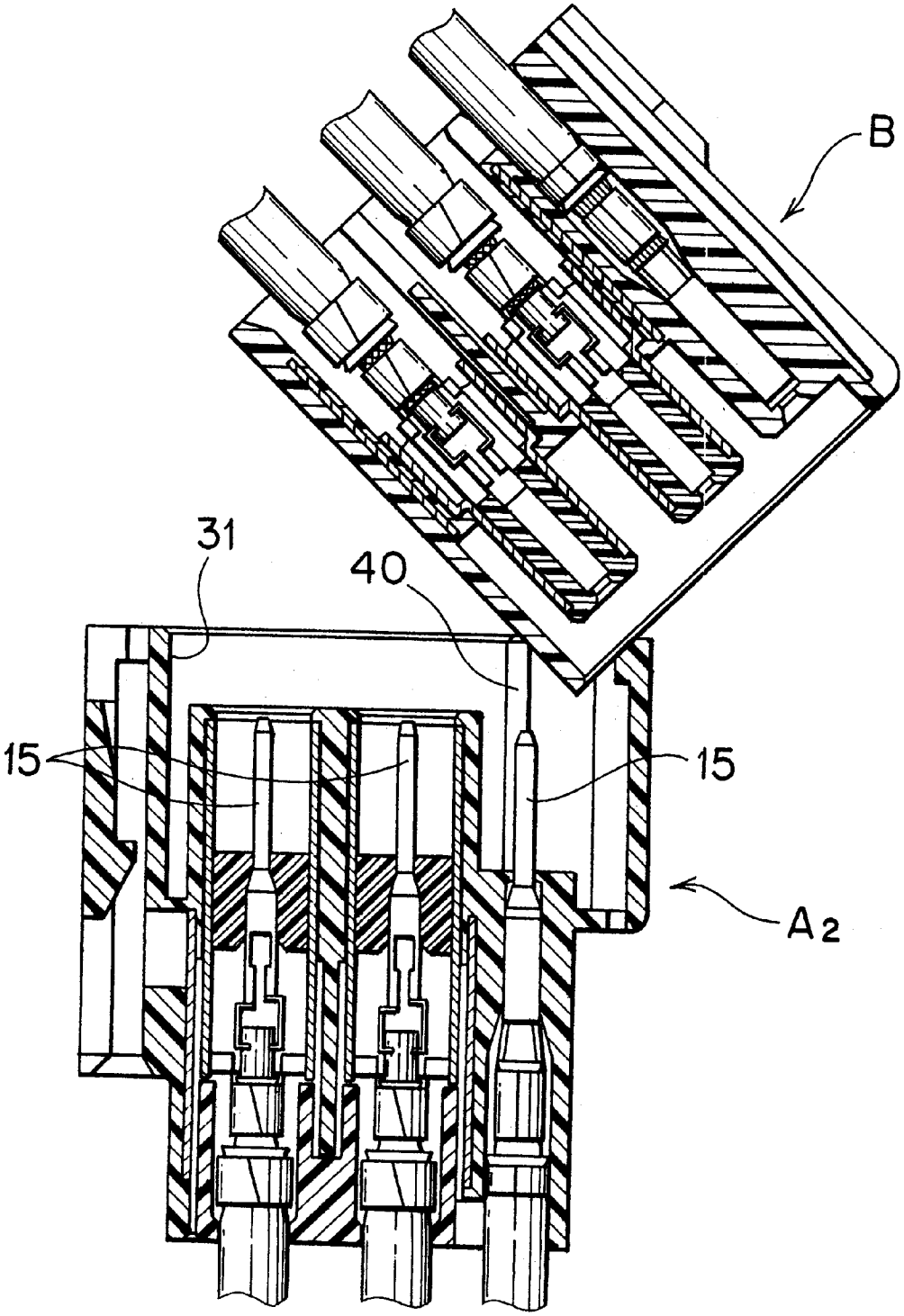
FIG. 10 is a sectional view in explaining an effect of a rib formed on an inner surface of an outer housing.

As shown in FIG. 10, the rib 40 prevents the inside terminals 15 from being brought contact with the opponent connector B which is inserted on an inexact coupling state.

In order to hold on a coupling state between the outer housing 18 and the opponent connector B, the present invention has a third portion 42 being formed on the outer housing 18 and an projection 41 on a front portion of the third portion 42 so as to be engaged with a flexible locking arm 56 of the opponent connector B.

As referring to FIG. 2 to FIG. 6, an assembling procedure of a shielding connector with a board attached A1 will be below.

Figure 6A:
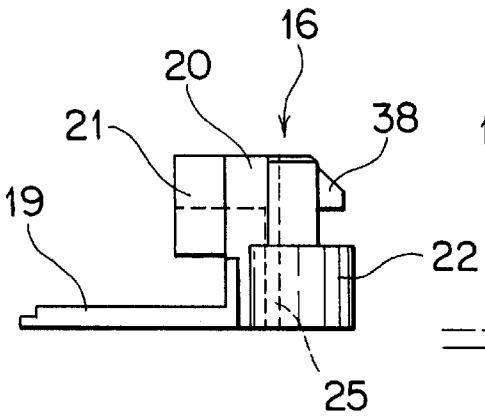
FIG. 6A is an elevational view of FIG. 5A.
Figure 6B:
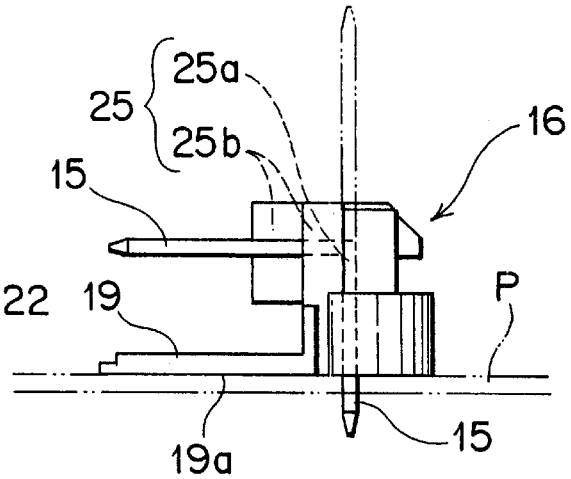
FIG. 6B is an elevational view showing the insertion of the inside terminals onto the inner housing.

FIGS. 5A and 6A show the inner housing 16 not having the inside terminals 15 therein. As shown in FIGS. 5B and 6B, after being inserted into the hole 25 of the terminal chambers 20, 21, each medium of the inner terminals 15 is bent like L.

Figure 6C:
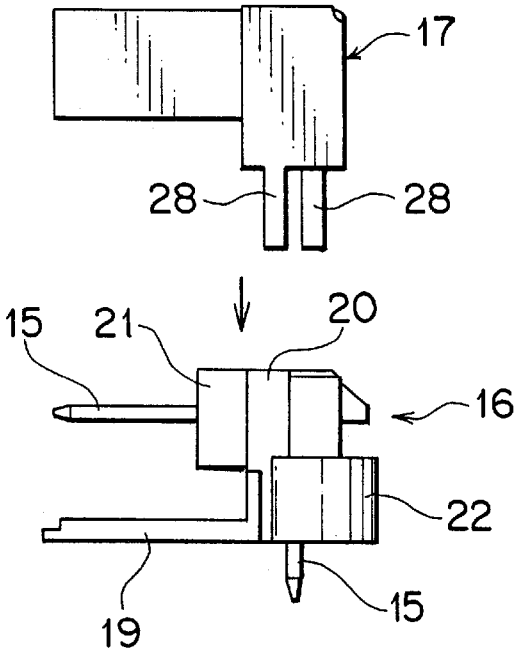
FIG. 6C is an elevational view showing the insertion of the shielding case onto the inner housing.
Figure 6D:
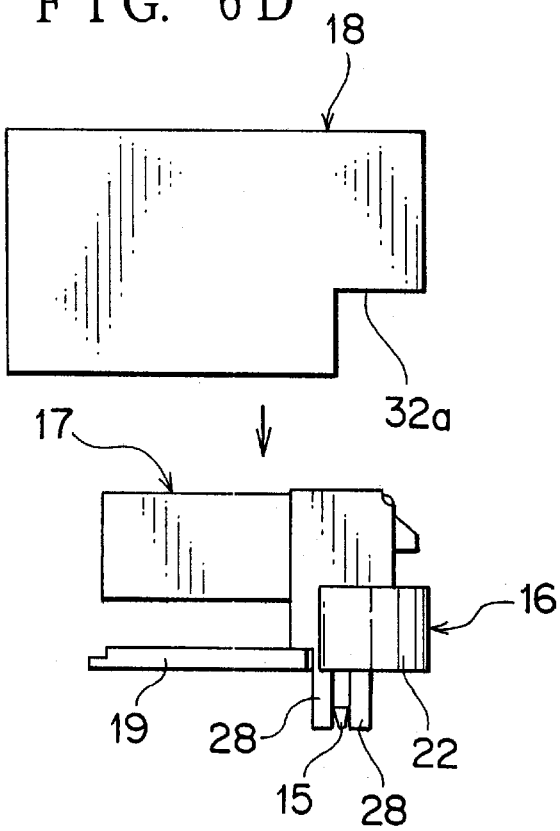
FIG. 6D is an elevational view showing the attachment of the outer housing onto the inner housing of the shielding connector.

As shown in FIG. 6C, when a lower end of the shielding case 17 collides against the bottom wall 19, the horizontal tubes 17*a* of the shielding case 17 accommodate the terminal chambers 20 and the vertical tubes 17*b* accommodate the inner terminals 15. As shown in FIG. 3, the fingers 29 of the shielding case 17 are engaged with the grooves 30 of the terminal chambers 20 respectively. So, the shielding case 17 and the inner housing 16 are fixed without being detached to each other.

Thus, as shown in FIGS. 5C and 3, each lower end of the inside terminals 15 and the shielding terminals 28 projects from a lower surface of the bottom wall 19.

As shown in FIG. 2 to FIG. 4, when the inner housing 16 with the shielding case 17 is inserted from the inserted hole 32 into the outer housing 18, the terminal chambers 20 are arranged between the partitions 36 and the first step 27 is engaged with the second step 35. So, the inner housing 16 holds the shielding case 17 without being detached to each other and the lower wall 19 fully closes an opening of the inserting hole 32. And, the recesses 32 of the outer housing 18 receive the arms 22 of the inner housing 16 respectively.

Therefore, by one touching performance of inserting the inner housing 16 into the outer housing 18, the outer housing 18 positions the inner housing 16 and holds without being detached to each other, and then the inner housing 16 fully closes the hole 32 formed for inserting the inner housing 16.

Since the outer housing 18 directly positions the inner housing 16, the inside terminals 15 do not depend on total position errors of assembling each of conventionally used parts to each other.

As shown in FIG. 2, the opponent connector B being inserted into the hole 31 of the outer housing 18 has, in a connector housing 43, female-type shielding terminals being attached to shielding wires W and female-type terminal 45 being attached to a covered wire W'. When the outer housing 43 fits the inner housing 18, the female-type shielding terminals 44 electrically connect the inside terminals 15 inserted within the terminal chamber 20 respectively.

As shown in FIG. 2, the engaging projection 41 of the engaging portion 42 secures a tip portion of a locking arm 56 mounted on the connector housing 43. In the outer housing 18, a securing state of both is held.

Figure 9:
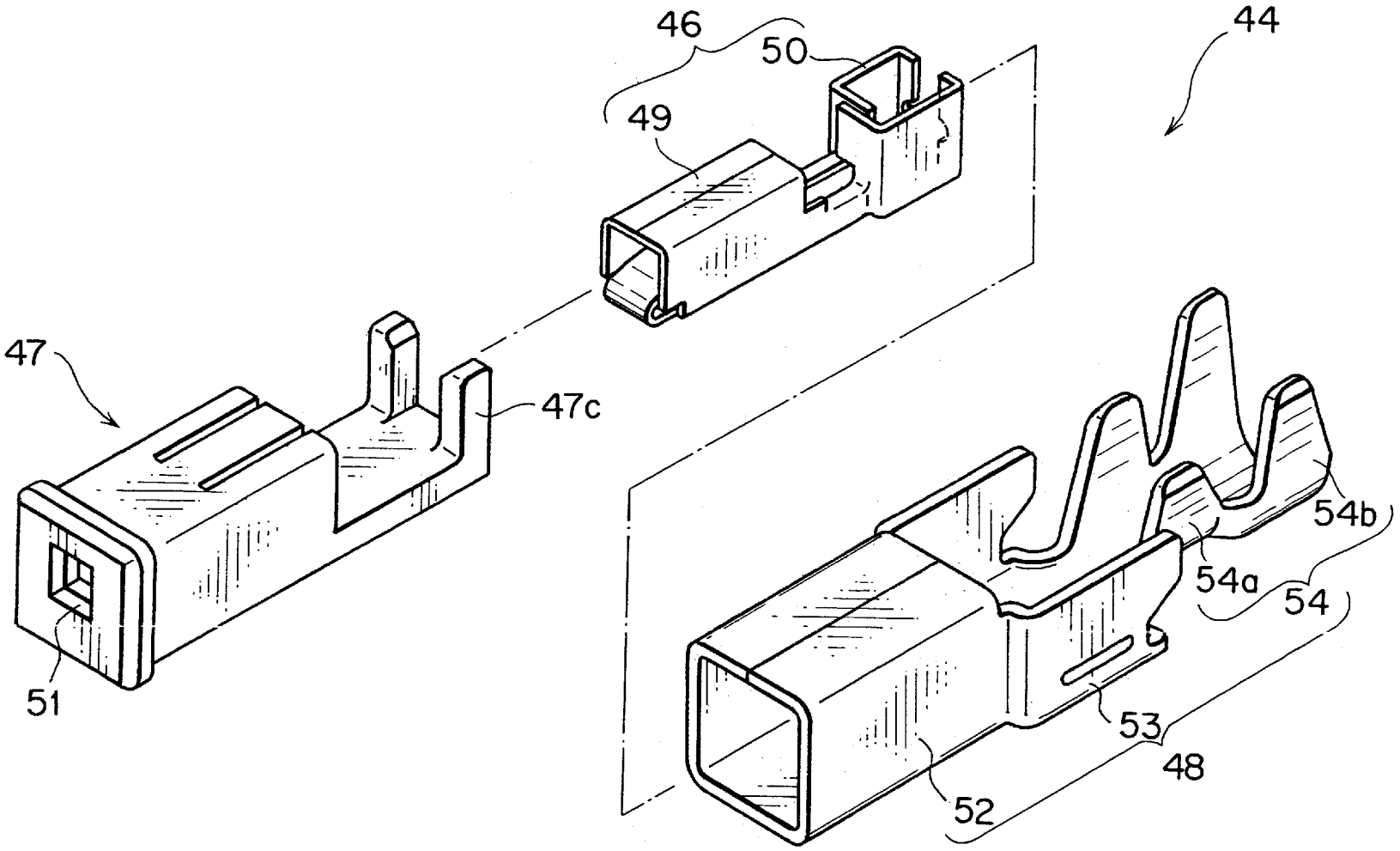
FIG. 9 is an exploded perspective view of the female-type shielding terminal in FIG. 8.

As shown in FIG. 9, each of the female-type shielding terminals 44 being attached to the shielding wire W comprises the female-type inner terminal 46, and a holder 47 for accommodating the female-type inner terminal 46, and an external terminal 48 for receiving the holder 47.

The female-type inner terminal 46 has an electric connecting portion 49 for inserting one of the inside terminals 15 and a wire connecting portion 50 for connecting the shielding wire W. The holder 47 has, at a tip end thereof an opening 51 for receiving one of the inside terminals 15.

The external terminal 48 has an expanding portion 53 extending from a rear end of a rectangular tube-shaped covering portion 52 and then a wire connecting portion 54 for connecting the shielding wire W. As shown in FIG. 2, the expanding portion 53 contacts to one of the shielding boards 55 which are arranged in the connector housing 43. The wire connecting portion 54 consists of a pair of braided wire-type pressure portions 54*a* for pressing a braided wire W2 of the shielding wire W, and then a pair of electrically insulator covered wire-type pressure portions 54*b* for pressing a insulator covered wire W3 of the shielding wire W. Reference numeral 47*c* indicates a pair of core pressure portions, which are mounted on a lower wall of the holder 47 and are connected to an exposed core W1 peeled from the braided wire W2.

Figure 8:
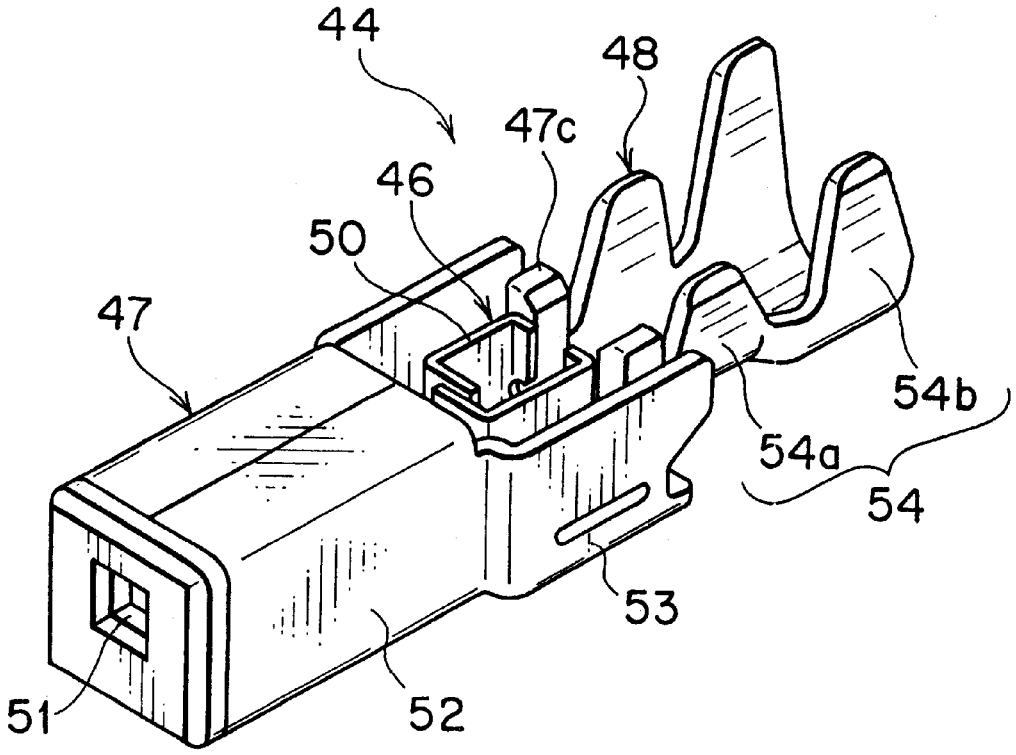
FIG. 8 is a perspective view of a female-type shielding terminal accommodated in an opponent connector.

As shown in FIG. 8, the female-type shielding terminal 44 is formed by assembling, to each other, the female-type terminal 46, the holder 47, and the external terminal 48, and is accommodated within the connector housing 43.

Figure 7:
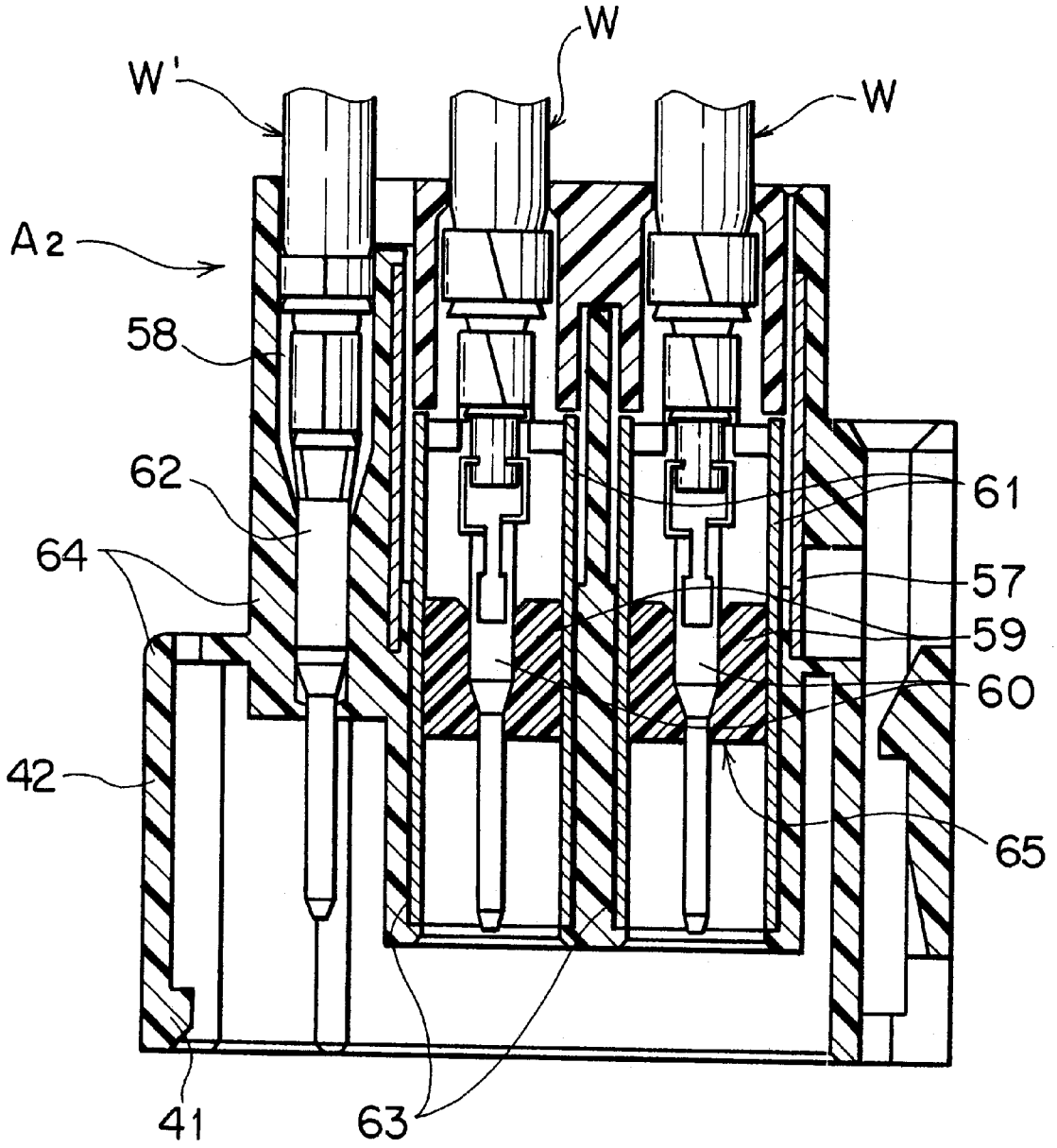
FIG. 7 is a sectional view of a shielding connector which shows a second embodiment of the present invention.

FIG. 7 shows a sectional view of the shielding connector A2 which is a second embodiment of the present invention. The shielding connector A1 attached to a board, the first embodiment is connected to the printed board P while this shielding connector A2 is a terminal inserting type of connector so as to insert both terminals being pressed on the shielding wire W and the covered wire W'.

The shielding connector A2 has the same structure as that of the first embodiment and comprises a hole (not shown for a rear side of FIG. 7) corresponding to the hole 32, and an outer housing 64 having therein a pair of shielding boards 57 and a terminal chamber 58, and then an inner housing 65 being integrally formed with a bottom wall(not shown for a rear side of FIG. 7) and terminal chambers 59. The terminal chambers 59 are located on an inner surface of the bottom wall for closing the hole.

The terminal chambers 59 accommodate male-type shielding terminals 60 being pressed on the shielding wire W. A shielding case 61 contacting to the shielding boards 57 is attached to each outer surface of the terminal chambers 59 so as to coat the male-type shielding terminals 60.

The male-type inner terminals 63 constituting the male-type shielding terminals 60 is similar to the female-type shielding terminals 44 of the opponent connector B except that the female-type electrical connecting portion 49 of the female-type inner terminal 46 replaces a male-type one.

Since the shielding case 61 is not coupled with the terminal chamber 58 for accommodating a male-type terminal 62 of the covered wire W', the terminal chamber 58 is integrally formed with the outer case 64. Preferably, the terminal chamber 58 is integral with the inner housing 65 so as to be formed by the same means as those of the first embodiment.

A performance of both assembling, to each other, the outer housing 64 and inner housing 65 and fitting the shielding connector A2 and the opponent connector B is similar to that of the first embodiment.

What is claimed is:

1. A shielding connector for receiving an opponent connector comprising:

an inner housing integrally formed further comprising, a bottom wall forming the bottom of the shielding connector and supporting the remainder of the inner housing, the bottom wall having a front end corresponding to a front of the shielding connector and a rear end corresponding to a rear of the shielding connector, a plurality of terminal chambers for accommodating electrical terminals, the plurality of terminal chambers formed on the rear end of the bottom wall, and a guide wall formed between terminal chambers;

a terminal associated with each of the plurality of terminal chambers and extending toward the front of the shielding connector;

a shielding case for shielding appropriate terminal chambers and terminals; and an outer housing associated with the bottom wall and covering the remainder of the inner housing and having an opening at the front of the shielding connector.

2. The shielding connector set forth in claim 1, wherein an outer surface of said bottom wall abuts on a printed board, one end of each of said terminals is connected to said terminal of said opponent connector, and the other end is connected to said printed board.

3. The shielding connector set forth in claim 1, further comprising:

a first portion formed on an outer surface of the terminal chamber of said inner housing; and a second portion formed on said outer housing for engaging with said first portion when said inner housing is attached to said outer housing.

4. The shielding connector set forth in claim 2, further comprising:

a first portion formed on an outer surface of the terminal chamber of said inner housing; and a second portion formed on said outer housing for engaging with said first portion when said inner housing is attached to said outer housing.

5. The shielding connector set forth in claim 1, further comprising:

a finger formed on an outer surface of said shielding case and a groove formed on said outer housing on an inner surface thereof for engaging the finger when said shielding case is attached to said inner housing.

6. The shielding connector set forth in claim 2, further comprising:

a finger formed on an outer surface of said shielding case and a groove formed on said outer housing on an inner surface thereof for engaging the finger when said shielding case is attached to said inner housing.

7. The shielding connector set forth in claim 1, further comprising:

a third portion formed on a surface of one of said outer housing and said inner housing so as to secure the other when said outer housing and said inner housing are coupled with each other; and an engaging projection mounted on a tip end of said third portion.

8. The shielding connector set forth in claim 2, further comprising:

a third portion formed on a surface of one of said outer housing and said inner housing so as to secure the other when said outer housing and said inner housing are coupled with each other; and an engaging projection mounted on a tip end of said third portion.

9. The shielding connector set forth in claim 1 further comprising:

a rib mounted on an outer surface of said outer housing for guiding said opponent connector, wherein said rib is arranged in such a position to prevent said terminal from being brought into contact with said opponent connector when said opponent connector is inserted inexactly.

10. The shielding connector set forth in claim 2, further comprising:

a rib mounted on an outer surface of said outer housing for guiding said opponent connector, wherein said rib is arranged in such a position to prevent said terminal from being brought into contact with said opponent connector when said opponent connector is inserted inexactly.

* * * * *